US010214865B2

(12) United States Patent
Meier et al.

(10) Patent No.: US 10,214,865 B2
(45) Date of Patent: Feb. 26, 2019

(54) EARTH WORKING ROLLER

(71) Applicant: Hamm AG, Tirschenreuth (DE)

(72) Inventors: Matthias Meier, Tirschenreuth (DE); Reiner Bartsch, Tirschenreuth (DE)

(73) Assignee: Hamm AG, Tirschenreuth (DE)

( * ) Notice: Subject to any disclaimer, the term of this patent is extended or adjusted under 35 U.S.C. 154(b) by 26 days.

(21) Appl. No.: 15/860,810

(22) Filed: Jan. 3, 2018

(65) Prior Publication Data

US 2018/0187381 A1 Jul. 5, 2018

(30) Foreign Application Priority Data

Jan. 4, 2017 (DE) ..... 10 2017 100 069

(51) Int. Cl.

| | |
|---|---|
| ***E01C 19/23*** | (2006.01) |
| ***E02D 3/02*** | (2006.01) |
| ***E01C 19/28*** | (2006.01) |
| ***E01C 19/26*** | (2006.01) |
| ***E01C 23/12*** | (2006.01) |
| ***E02D 3/026*** | (2006.01) |
| ***E02D 3/046*** | (2006.01) |

(52) U.S. Cl.

CPC ..... *E01C 19/236* (2013.01); *E01C 19/266* (2013.01); *E01C 19/281* (2013.01); *E01C 23/12* (2013.01); *E02D 3/026* (2013.01); *E02D 3/046* (2013.01)

(58) Field of Classification Search

CPC .... E01C 19/236; E01C 19/266; E01C 19/281; E02D 3/026

See application file for complete search history.

(56) References Cited

U.S. PATENT DOCUMENTS

| | | | | |
|---|---|---|---|---|
| 324,166 A * | 8/1885 | Riordan | ..... | E01C 19/236 172/351 |
| 1,099,185 A * | 6/1914 | Loveland | ..... | E01C 19/236 404/124 |
| 2,582,199 A * | 1/1952 | Gardner | ..... | E01C 19/236 172/547 |

(Continued)

FOREIGN PATENT DOCUMENTS

| | | |
|---|---|---|
| AU | 2016201595 | 9/2016 |
| DE | 102014201240 | 7/2015 |

(Continued)

OTHER PUBLICATIONS

German Search Report filed in 102017100069.0 dated Jul. 12, 2017.
European Search Report filed in EP 17208521 dated Apr. 9, 2018.

*Primary Examiner* — Abigail A Risic
(74) *Attorney, Agent, or Firm* — Rankin, Hill & Clark LLP

(57) ABSTRACT

An earth working roller for use in an earth working machine includes a roller drum, which extends in a direction along a roller axis of rotation, surrounds a roller interior, and has a circular outer circumferential contour, wherein a substrate breaking configuration is provided on the outer circumferential surface of the roller drum. The substrate breaking configuration includes a plurality of impact bars along the roller drum in the direction of the roller drum axis of rotation, as well as a plurality of breaker bars along the roller drum in a circumferential direction.

12 Claims, 6 Drawing Sheets

(56) References Cited

Figure 1:
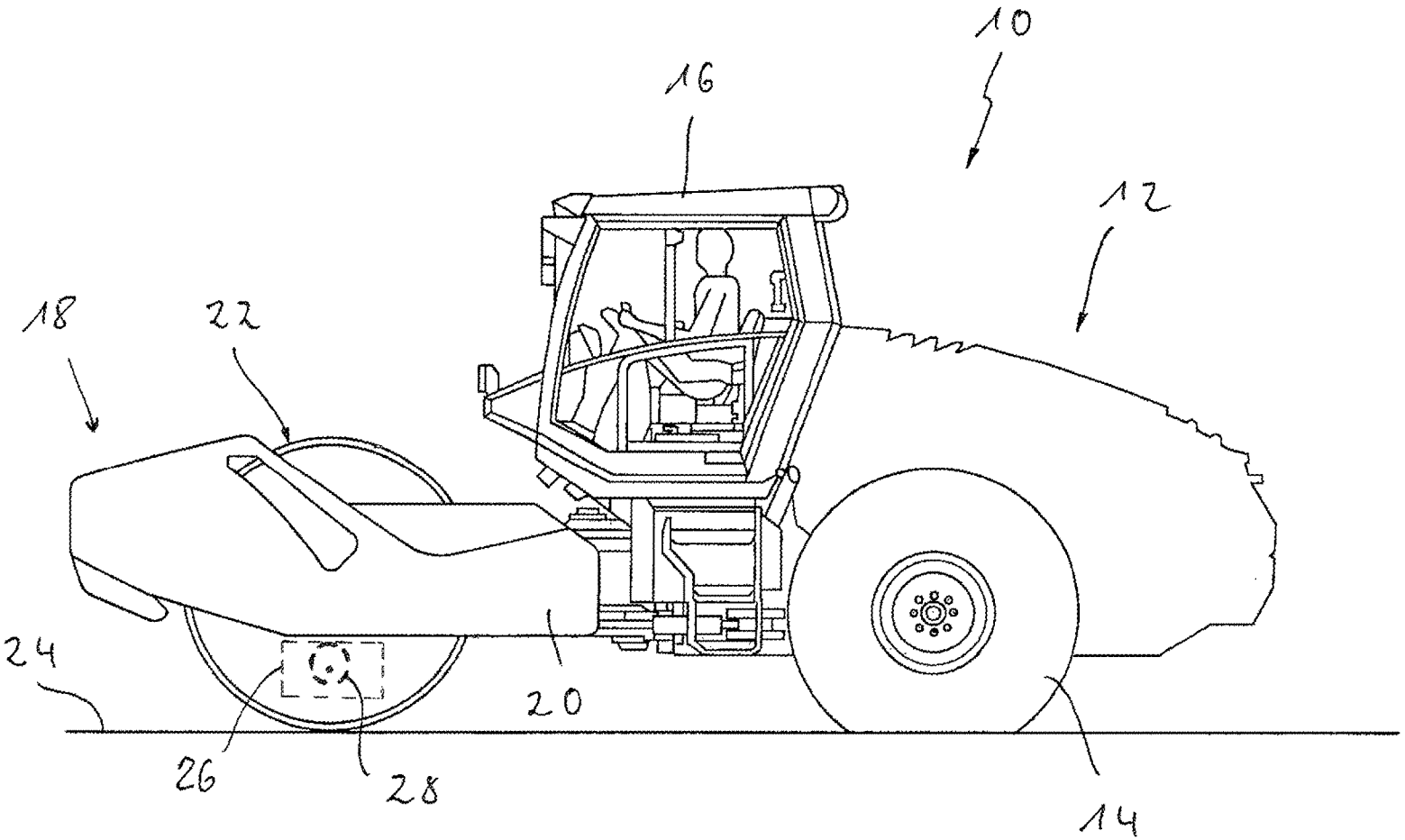

U.S. PATENT DOCUMENTS 2,585,117 A * 2/1952 Gurries ..... E02D 3/026 172/252
2,678,593 A * 5/1954 Hugman ..... E01C 3/04 172/68
2,911,893 A * 11/1959 Archibald ..... E02D 3/026 209/285
3,071,050 A * 1/1963 Shatto ..... E02D 3/026 172/554
3,665,822 A * 5/1972 Speer ..... E01C 19/231 404/130
3,687,023 A * 8/1972 Moser ..... A01B 29/045 172/52
3,823,983 A * 7/1974 Peterson ..... E02D 3/026 301/43
3,832,079 A * 8/1974 Moorhead ..... B44B 5/0009 404/124
3,922,106 A 11/1975 Caron et al.
4,105,354 A * 8/1978 Bowman ..... B44B 5/0009 172/540
4,193,457 A * 3/1980 Sphar ..... A01B 29/045 172/464
4,523,873 A 6/1985 Elliot
4,750,792 A * 6/1988 Caron ..... E02D 3/026 305/114
4,775,262 A * 10/1988 Guntharp ..... E01C 19/236 404/103
5,033,906 A * 7/1991 Jordan ..... B44B 5/0009 404/124
5,114,269 A * 5/1992 Shepherd ..... E01C 19/236 404/122
5,228,799 A * 7/1993 Sondreal ..... E01C 19/43 404/124
5,421,670 A * 6/1995 Meirick ..... E01C 19/43 404/124
5,791,815 A * 8/1998 Rowe ..... E01C 19/285 404/103
5,826,808 A * 10/1998 Giovanardi ..... A01B 27/00 241/27
5,860,764 A * 1/1999 Roberts ..... E01C 19/236 404/124
7,410,323 B1 8/2008 Roth
9,326,439 B2 * 5/2016 Westlind ..... A01B 33/142
2016/0047103 A1 * 2/2016 Pratt ..... E02D 3/026 404/121

FOREIGN PATENT DOCUMENTS

EP 2142706 1/2010
WO 2013107545 7/2013

* cited by examiner

EARTH WORKING ROLLER

The present invention relates to an earth working roller for use in an earth working machine comprising a roller drum, which extends in a direction along a roller axis of rotation, surrounds a roller interior, and has an essentially circular outer circumferential surface, whereby a substrate breaking configuration is provided on the outer circumferential surface of the roller drum.

Earth working machines are commonly constructed in the form of so-called soil compactors and use rollers of this kind in order to crush a solid substrate, for example a concrete substrate.

Known from WO 2013/107545 A1 is an earth working roller comprising a roller drum designed to have an essentially circular outer circumferential surface and a plurality of quick-change tool holders, which are attached to the outer circumferential surface of the roller drum and to which a drum tool, for example a chisel, can be attached. The quick-change tool holders are arranged along a plurality of rings, which are arranged adjacent to one another in the direction of a roller axis of rotation at essentially uniform circumferential distances, whereby the quick-change tool holders and, correspondingly, the drum tools to be attached thereto, are arranged in respectively adjacent rings and are offset from one another in a circumferential direction.

Known from DE 10 2014 201 240 A1 is an earth working roller featuring a plurality of cutting rings, which are arranged on the outer circumferential surface of the roller drum at a uniform distance from one another in the direction of a roller axis of rotation and have essentially a V-shaped or chisel-shaped cross section.

U.S. Pat. No. 4,523,873 discloses an earth working roller provided with a substrate breaking configuration on the outer circumferential surface of a roller drum. This well-known substrate breaking configuration comprises a plurality of lugs designed to follow a continuous zig-zag pattern in the direction of the roller axis of rotation. These lugs are primarily suitable for breaking rock, and are less suitable for breaking up continuous slabs of concrete.

EP 2 142 706 B1 discloses an earth working roller having an approximately square—hence not essentially circular—outer circumferential contour. Provided at a number of circumferential positions are crushing elements, which, by virtue of their non-circular outer circumferential contour, periodically strike the substrate during rotary movement of said earth working roller, thus breaking up the substrate.

It is the object of the present invention to provide an earth working roller for use in an earth working machine which is more suitable for breaking up a solid substrate, in particular a concrete substrate.

According to the invention, this object will be achieved by means of a earth working roller for use in an earth working machine comprising a roller drum, which extends in a direction along a roller axis of rotation, surrounds a roller interior, and has an essentially circular outer circumferential surface, whereby a substrate breaking configuration is provided on the outer circumferential surface of the roller drum.

This earth working roller is characterized by the substrate breaking configuration comprising a plurality of impact bars along the roller drum essentially in the direction of the roller drum axis of rotation, as well as a plurality of breaker bars along the roller drum in an essentially circumferential direction.

First of all, providing the grid-like pattern formed by the impact bars and the breaker bars ensures that correspondingly grid-shaped segments will be broken away from the substrate being crushed during earthworking operations, for example breaking up a concrete surface in order to dismantle it. These segments can then be easily removed using additional machines, for example excavators or wheel loaders. Second, the breaker bars, which extend essentially in a circumferential direction, ensure that the earth working roller performs an essentially uniform rolling motion upon the substrate being broken up while being guided in a defined manner and not tending to drift laterally, particularly when the substrate is inclined in a direction transverse to the direction of travel of an earth working machine equipped with an earth working roller of this kind.

In order to guarantee a uniform working of the substrate, it is recommended that the impact bars be arranged in a circumferential direction around the roller axis of rotation and spaced at essentially equal circumferential distances from one another. The circumferential distance may range, for example, from 40 to 60 cm, and is preferably approximately 50 cm.

A highly durable impact bar structure can be provided by, for example, the impact bars featuring an essentially rectangular but preferably square cross section, whereby the impact bar cross section preferably measures in the range of 40 mm×40 mm.

In order to guarantee that the substrate being processed, for example a concrete slab, is completely broken up, it is recommended that the impact bars span the roller drum essentially without interruption in the direction of the roller axis of rotation.

Furthermore, uniform processing of the substrate being broken up can be assisted by means of the breaker bars arranged in at least one of the spaces between impact bars adjacent in a circumferential direction to one another, and preferably the breaker bars arranged in all of the spaces between impact bars adjacent in a circumferential direction to one another, being arranged about the roller axis of rotation at an essentially uniform axial distance from one another.

In accordance with a particularly advantageous aspect of the earth working roller constructed according to the invention, it may be provided that the breaker bars arranged in spaces adjacent in a circumferential direction about the roller axis of rotation to one another and between two respective impact bars adjacent in the direction of the roller axis of rotation to one another are offset from one another. Offsetting the breaker bars from one another in an axial direction guarantees that the earth working roller can be guided laterally in a defined manner without, however, tending to become stuck on one course, thus retaining the maneuverability of an earth working machine equipped with an earth working roller of this kind. It can in particular be provided that the breaker bars in one of two spaces adjacent in a circumferential direction to one another are arranged to be essentially centered in the direction of the roller axis of rotation in relation to the breaker bars in the other of the two spaces adjacent in a circumferential direction from one another.

According to a further advantageous aspect, the defined lateral guidance of the earth working roller can be assisted along with retaining maneuverability and uniform earthworking performance by means of essentially no offset existing in the direction of the roller axis of rotation with respect to the breaker bars in every other of the successive spaces between each of two impact bars adjacent in a circumferential direction to one another.

The ability of the breaker bars to crush a substrate being broken up can be enhanced essentially without impeding the rolling motion of an earth working roller of this kind by means of at least a portion of and preferably all of the breaker bars lying essentially along a circular path concentrically encompassing the rotational axis of the roller, and/or by means of a depression being formed at an outer circumferential area of at least a portion of and preferably all of the breaker bars.

In order to ensure that the substrate can be effectively crushed with the help of the impact bars, which provide a relatively large footprint for the earth working roller upon the substrate being broken by virtue of their span essentially along the entire roller drum in the direction of the roller axis of rotation, it is recommended that the maximum radial height of a projection on a portion of and preferably all of the impact bars across the outer circumferential surface of the roller drum is greater than the maximum radial height of a projection on a portion of and preferably all of the breaker bars across the outer circumferential surface of the roller drum.

In order to further improve the ability of an earth working roller constructed according to the invention to crush a solid substrate such as a concrete slab, it is recommended to arrange within the roller interior a vibratory arrangement which is able to generate vibration translatable via a rotating motion about the roller axis of rotation to the earth working roller. Vibration of this kind is a periodic up and down motion or, rather, an acceleration of the earth working roller, hence a motion or acceleration essentially in a vertical direction. As a consequence, the earth working roller periodically strikes against the substrate being crushed.

The invention furthermore relates to an earth working machine comprising at least one machine frame around an earth working roller constructed according to the invention and supported to rotate about a roller axis of rotation.

Figure 2:
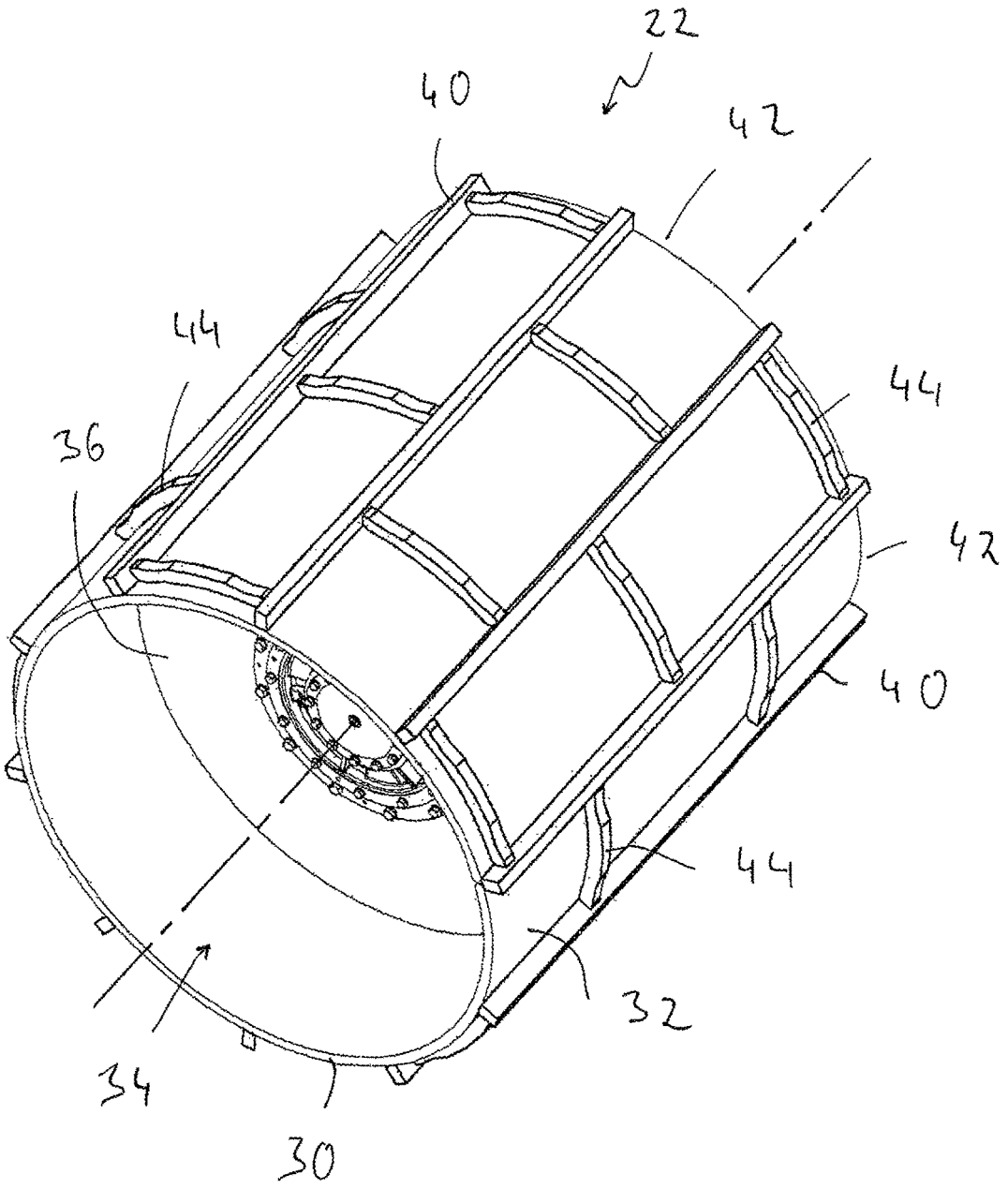
Figure 3:
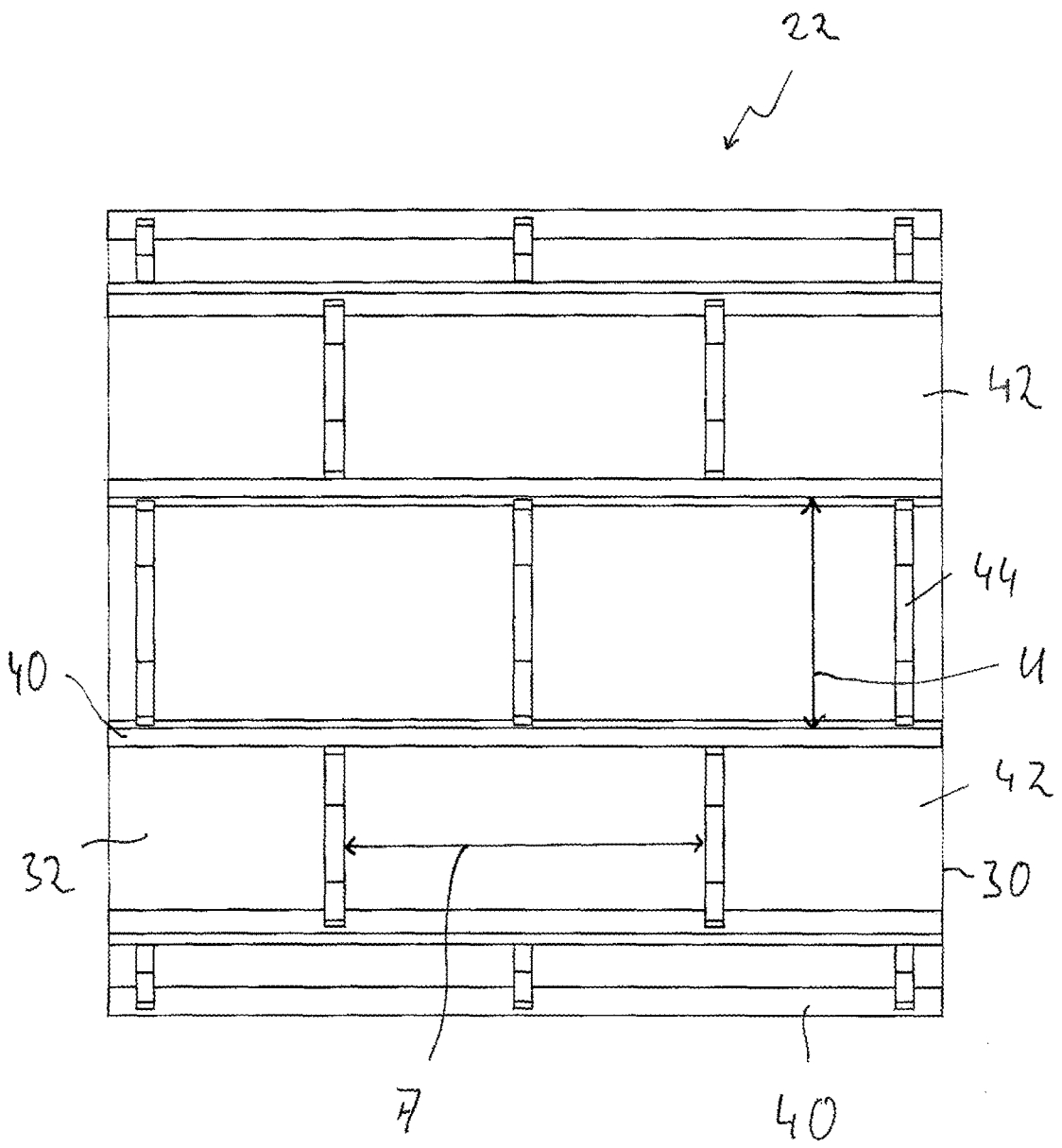
Figure 4:
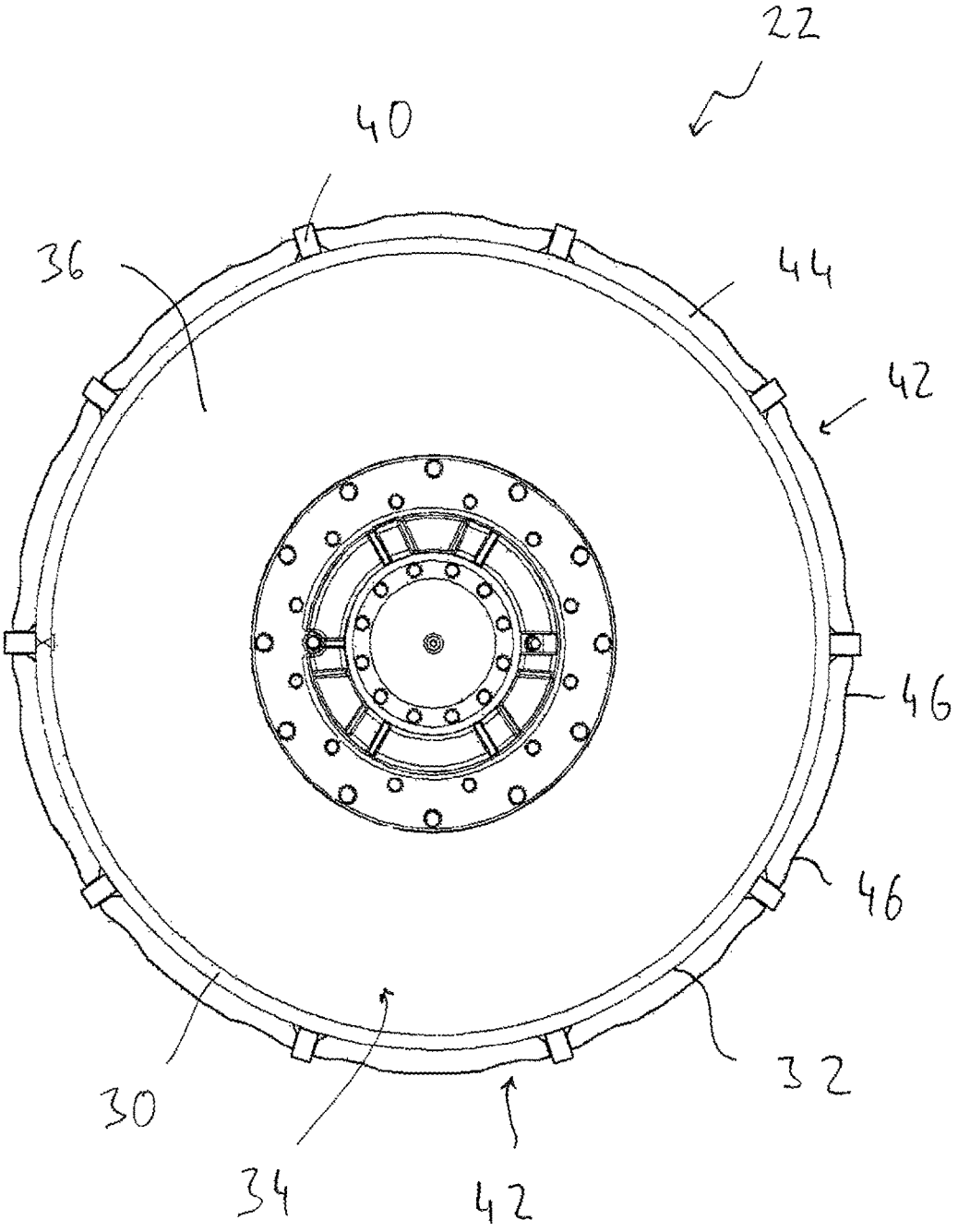
Figure 5:
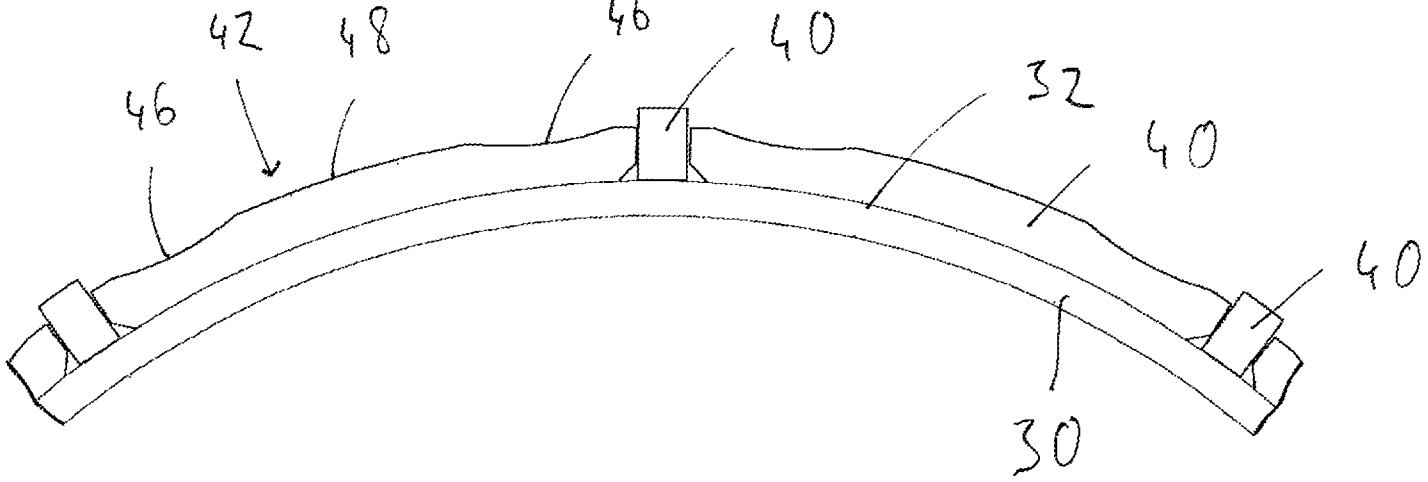
Figure 6:
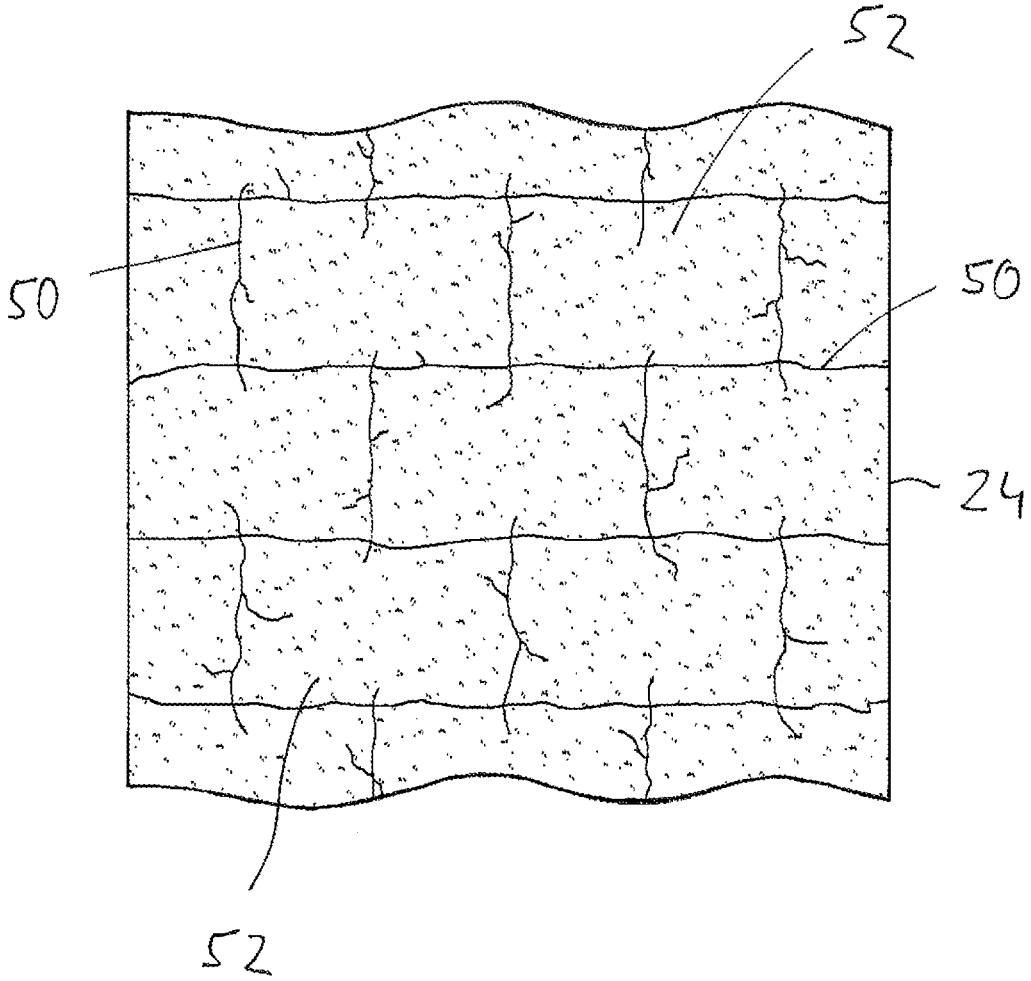

The present invention is described in detail hereinafter with reference to the enclosed drawings. Shown are:

FIG. 1 a side view of an earth working machine;

FIG. 2 a perspective view of an earth working roller able to be used along with the earth working machine in FIG. 1;

FIG. 3 a radial view of the earth working roller in FIG. 2;

FIG. 4 a radial view of the earth working roller in FIG. 2;

FIG. 5 a circumferential section of a roller drum of the earth working roller in FIG. 2;

FIG. 6 a section of the substrate having been processed using the earth working roller in FIG. 2.

FIG. 1 shows a side view of an earth working machine 10. The earth working machine 10 comprises a rear vehicle 12, in which a powertrain (not shown in FIG. 1) and drive wheels 14 driven thereby are provided. The person operating the earth working machine 10 is able to be seated in a driving cab 16.

Generally designated as 18 is a front vehicle of the earth working machine 10 comprising a machine frame 20 for steering the earth working machine 10 via the rear vehicle 12. The earth working roller 22 is supported by the machine frame and is able to rotate about a roller axis of rotation, which is orthogonal to the plane of the drawing in FIG. 1.

During earthworking operations, the earth working machine 10 moves in a forward direction or in a rearward direction, hence either to the left or the right in FIG. 1, in order to process or crush a substrate 24 being worked on, for example a concrete slab being dismantled. A substrate breaking configuration, which is described in detail hereinafter in reference to FIGS. 2 to 5, is provided on the earth working roller 22 for this purpose. Also able to be provided in the earth working roller 22 and generally designated as 26 is a vibratory arrangement having at least one unbalance mass 28, which is able to be driven about an unbalance axis of rotation in order to translate a vibration via the rotating motion of the earth working roller 22 about its roller axis of rotation into a motion or acceleration in an essentially vertical direction. It should be noted here that the vibratory arrangement 26 in FIG. 1 is illustrated only schematically, and it is self-evident that said arrangement will be arranged in the roller interior of the earth working roller 22 in a suitable position along with the system components provided for such a purpose.

The earth working roller 22 illustrated in FIGS. 2 to 5 is able during earthworking operations to rotate about a roller axis of rotation D. The earth working roller 22 comprises a roller drum 30 of simple cylindrical shape and having an outer circumferential surface 32. The roller drum 30 surrounds a roller interior 34, in which one or more roller disks 36 may be arranged in order to thereby rotatably support the earth working roller 22 on the machine frame 18.

Provided on the outer circumferential surface 32 of the roller drum 30 is the aforementioned substrate breaking configuration 38. This configuration comprises a plurality of impact bars 40, which extend parallel to the roller axis of rotation D and are affixed to the outer circumferential surface 32 by means, for example, of welding. The impact bars 40, which are arranged successively in a circumferential direction about the roller axis of rotation D, are preferably spaced at an essentially uniform circumferential distance U, which can range from 40 cm to 60 cm, and is preferably approximately 50 cm. It should be noted here that the circumferential distance D may be the unobstructed distance between two impact bars 40 adjacent in a circumferential direction to one another, hence the essentially circumferential extent of a space 42 formed between two impact bars 40 adjacent in a circumferential direction.

The impact bars 40, which preferably span without interruption in the direction of the roller axis of rotation D are, for example, of one-piece design and may feature a rectangular, preferably square, cross-sectional profile with a cross-sectional area of 40 mm×40 mm. It is also possible for the rectangular cross-sectional profile discernible in the drawings to have a greater extent in a radial direction than in a circumferential direction.

Several respective breaker bars 44 are arranged in each of the spaces 42 formed by two impact bars 40 adjacent to one another in a circumferential direction. The breaker bars 44 arranged in a respective space 42 extend along the outer periphery or, rather, the outer circumferential surface 32 of the roller drum 30 in a circumferential direction, hence essentially vertically to the impact bars 42. The circumferential span of the breaker bars 44 preferably corresponds to the circumferential extent of one of these respectively bordered spaces 42. Consequently, the circumferential ends of the breaker bars 44 adjoin the impact bars 40, preferably without leaving a gap between said ends and the impact bars 44 bordering the respective space 42.

As is evident in FIG. 3, the breaker bars 44 arranged in immediately adjacent spaces 42 are situated to be offset from one another in the direction of the roller drum axis of rotation D. The offset is preferably such that the breaker bars 44 in one of the spaces 42 are situated to be essentially centered in the direction of the roller axis of rotation D relative to the breaker bars 44 arranged in the other spaces 42, thus resulting in the pattern discernible in FIG. 3, in which the breaker bars 44 arranged in every other space 42 essentially continue into one another, thus demonstrating no axial offset from one another.

The unobstructed distance A between breaker bars 44 situated in a respective space is in the range of about 70 cm, so the embodiment illustrated in FIGS. 2 to 5 can be used to produce an arrangement in which three breaker bars 44 are arranged in every other space 42, one of which is situated in an axially central area of the roller drum 30 while the other two are arranged near each axial end of the roller drum 30, and while two respective breaker bars 44 are arranged in the other spaces 42. As was already mentioned, these two breaker bars are arranged to be axially offset relative to the breaker bars 44 arranged in the adjacent spaces 42, this offset corresponding to approximately half of the axial distance A between respective breaker bars 44.

As is made clear by FIGS. 4 and 5, the maximum outward extent of the impact bars 40 from the outer circumferential surface 32 of the roller drum 30 is greater in a radial direction than the extent of the breaker bars 44 in a circumferential direction. As a result, the breaker bars 44 have the appearance of an essentially concentric circular line around the roller axis of rotation D. Provided in the breaker bars 44 along this outer circumferential contour are preferably two depressions 46 arranged at a circumferential distance from one another, each of which is preferably near the circumferential end of a respective breaker bar 44.

A substrate breaking configuration 38 which is particularly suitable for breaking concrete floors is provided by way of the grid-like structure illustrated in FIGS. 2 to 5 comprising impact bars 40 and breaker bars 44. In this case, the earth working roller 22 along with the successive impact bars 40 provided in a circumferential direction thereon comes into periodic contact with the substrate being broken. In phases during which the impact bar 40 is in contact with the substrate, the breaker bars 44 are lying upon the substrate in a space 42 formed between two respective impact bars 40, and lying in particular on the substrate with their circumferentially middle areas 48, which are located between two depressions 46. When, in particular, a vibration is generated by means of a vibratory arrangement 26 arranged in the roller interior 34 and translated via the rotating motion of the earth working roller 22, those areas of the substrate breaking configuration 38 which are in contact with the substrate being crushed will be broken up in an efficient manner, thus producing the pattern of cracks 50 in the substrate 24 discernible in FIG. 6. This pattern essentially corresponds to the grid-like pattern formed by the impact bars 40 and the breaker bars 44 on the outer circumferential surface 32 of the roller drum 33, thus producing a plurality of segments 52 separated from one another by such cracks. These segments can be separated from one another and carried away by another earth working machine, for example an excavator or a wheel loader.

In particular, providing breaker bars 44 in the respective spaces 42 in a circumferential direction between adjacent impact bars 40 does more than provide crushing functionality; these breaker bars 44 also make a significant contribution to guiding the earth working roller 22 and, as a consequence, guiding the forward advance of the earth working machine 10. The breaker bars 44, which are essentially in continuous contact with the substrate 24 being processed, prevent drift in a lateral direction. However, situating the breaker bars 44 in adjacent spaces to be offset from one another in the direction of the roller axis of rotation D prevents the tendency to become stuck on one course, thus avoiding difficulties in steering the earth working machine 10, in particular by means of pivoting the front vehicle 18 in relation to the rear vehicle 12.

In conclusion, it should be noted that, as is self-evident, the impact bars 40 and the breaker bars 44 provided on the outer circumference of the roller drum 30 may be arranged in a different pattern. Thus, arranging the impact bars 40 to be at essentially the same circumferential distance from one another is particularly advantageous. However, a varying distance in a circumferential direction could also be provided. Nor must the respective breaker bars arranged in the spaces 42 necessarily be provided at the same axial distance. For example, the breaker bars could thus be arranged in a space 42 at an alternating axial distance smaller than the distance provided in the spaces 42 on either side. In addition, a variation of the axial distance of the breaker bars within a respective space could be provided, whereby the essentially uniform, grid-like structure illustrated in FIGS. 2 to 5 is particularly advantageous for obtaining the segments 52 of crushed substrate 24 of essentially uniform size discernible in FIG. 6.

The invention claimed is:

1. An earth working roller for use in an earth working machine comprising a roller drum, which extends in a direction along a roller axis of rotation, surrounds a roller interior, and has a circular outer circumferential contour, wherein a substrate breaking configuration is provided on an outer circumferential surface of the roller drum, wherein the substrate breaking configuration comprises a plurality of impact bars along the roller drum in the direction of the roller drum axis of rotation, as well as a plurality of breaker bars along the roller drum in a circumferential direction, wherein the maximum radial height of a projection of at least some of the impact bars across the outer circumferential surface of the roller drum is greater than the maximum radial height of a projection of at least some of the breaker bars across the outer circumferential surface of the roller drum.

2. The earth working roller according to claim 1, wherein the impact bars are arranged in the circumferential direction around the roller axis of rotation and spaced at equal circumferential distances from one another.

3. The earth working roller according to claim 2, wherein each circumferential distance ranges from 40 to 60 cm.

4. The earth working roller according to claim 1, wherein each impact bar features a rectangular cross section, wherein the cross section of the impact bar measures in the range of 40 mm×40 mm.

5. The earth working roller according to claim 1, wherein each impact bar spans the roller drum without interruption in the direction of the roller axis of rotation.

6. The earth working roller according to claim 1, wherein the breaker bars arranged in at least one space between impact bars adjacent in a circumferential direction to one another are arranged about the roller axis of rotation at a uniform axial distance from one another.

7. The earth working roller according to claim 1, wherein the breaker bars arranged in spaces adjacent in a circumferential direction about the roller axis of rotation to one another and between two respective impact bars adjacent in the direction of the roller axis of rotation to one another are offset from one another.

8. The earth working roller according to claim 7, wherein the breaker bars in one of two spaces adjacent in a circumferential direction to one another are arranged to be centered in the direction of the roller axis of rotation in relation to the breaker bars in the other of the two spaces adjacent in a circumferential direction from one another.

9. The earth working roller according to claim 7, wherein no offset exists in the direction of the roller axis of rotation with respect to the breaker bars in every other of the successive spaces between each of two impact bars adjacent in a circumferential direction to one another.

10. The earth working roller according to claim 1, wherein at least a portion of the breaker bars lie along a circular path concentrically encompassing the roller rotational axis or that a depression is formed at an outer circumferential area of at least a portion of all of the breaker bars.

11. The earth working roller according to claim 1, wherein arranged within the roller interior is a vibratory arrangement configured to generate vibration translatable via a rotating motion about the roller axis of rotation to the earth working roller.

12. The earth working machine comprising at least one machine frame around an earth working roller constructed according to the claim 1 and supported to rotate about a roller axis of rotation.

* * * * *